US009818381B1

(12) United States Patent
Chang

(10) Patent No.: US 9,818,381 B1
(45) Date of Patent: Nov. 14, 2017

(54) SELF-RELEASE AND SELF-LOCKING STRING LOCKING MECHANISM

(71) Applicant: PING WELL INDUSTRIAL CO., LTD., Taichung (TW)

(72) Inventor: Tsung-Min Chang, Taichung (TW)

(73) Assignee: PING WELL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 15/479,767

(22) Filed: Apr. 5, 2017

(51) Int. Cl.
*G10D 3/14* (2006.01)

(52) U.S. Cl.
CPC ..... *G10D 3/14* (2013.01)

(58) Field of Classification Search
CPC ..... G10D 3/14
See application file for complete search history.

(56) References Cited

U.S. PATENT DOCUMENTS 4,827,825 A 5/1989 Goto et al.
2007/0295186 A1* 12/2007 Goto ..... G10D 3/14 84/304

* cited by examiner

*Primary Examiner* — Kimberly Lockett
(74) *Attorney, Agent, or Firm* — Muncy, Geissler, Olds & Lowe, P.C.

(57) ABSTRACT

A self-releasing and self-locking string locking mechanism for adjusting a string includes a fixed seat mounted on a stringed instrument, a worm shaft, a worm gear, a rotating shaft and a sleeve. The worm shaft drives and rotates the worm gear, and is installed on the fixed seat. The rotating shaft, pivotally connected on the fixed seat and secured on the worm gear, includes a self-releasing thread having a pitch thread between 1.25 mm and 1.6 mm and applied with a lubricant, and a locking pin. The sleeve is for the locking pin to be inserted therein, and internally includes an inner thread corresponding to the self-releasing thread and a lower surface for the locking pin to abut against. The sleeve is further provided with a through opening for the string to pass through near the lower surface.

6 Claims, 4 Drawing Sheets

SELF-RELEASE AND SELF-LOCKING STRING LOCKING MECHANISM

FIELD OF THE INVENTION

The present invention relates to a string locking mechanism for a stringed instrument, and particularly to a self-release and self-locking string locking mechanism.

BACKGROUND OF THE INVENTION

FIG. 1 shows a string tuning device for a stringed instrument disclosed by the U.S. Pat. No. 4,827,825. The string tuning device is installed on an instrument such as a guitar, and adjusts the tightness of a string 4 to perform tuning. The string tuning device includes a sleeve 1. An internal thread part 2 and a core shaft 3 are respectively disposed at two ends of the sleeve 1, and a worm gear (not shown in FIG. 1) may be driven by rotating a worm knob (not shown in FIG. 1). Thus, the core shaft 3 is driven and rotated to change a distance between the internal thread part 2 and the core shaft 3, such that one end of a string 4 may pass the sleeve 1, and the sleeve 1 is rotated to cause the core shaft 3 and the internal thread part 2 clamp the string 4. The other end of the string 4 is fixed on the stringed instrument. Accordingly, when the string 4 is tensed and one end of the string 4 is clamped by the core shaft 3 and the internal thread part 2, the worm knob may be rotated to drive the sleeve 1 to rotate, thereby performing tuning through changing the tightness of the string 4.

The above conventional string tuning device allows the string 4 to be fixed on the sleeve 1 through a simple winding approach, and provides a self-locking function. However, when the string 4 is clamped by the core shaft 3 and the internal thread part 2, a lateral shearing and stretching force is generated upon the string 4 because the core shaft 3 presses tightly against the string 4 through rotation, hence significantly increasing the probability of breaking the string 4. Further, in this conventional string tuning device, to unlock the string 4, as the core shaft 3 has usually reached its minimum secure fastening torque and is thus dead locked, a word screwdriver is needed to first loosen the internal thread part 2 in order to separate the core shaft 3 and the internal thread part 2 and then unlock the string 4. Thus, operations of such conventional string tuning device are quite complicated.

SUMMARY OF THE INVENTION

It is an object of the present invention to disclose a string tuning device capable of self releasing and self locking and operable without tools to satisfy application requirements.

The present invention provides a self-releasing and self-locking string locking mechanism, which is installed on a stringed instrument to adjust a string. The self-releasing and self-locking string locking mechanism includes a fixed seat mounted on the stringed instrument, a worm shaft, a worm gear driven and rotated by the worm shaft, a rotating shaft and a sleeve. The worm shaft and the worm gear are installed on the fixed seat. The rotating shaft, pivotally connected on the fixed seat and secured on the worm gear, includes a self-releasing thread and a locking pin. The self-releasing thread has a thread pitch between 1.25 mm and 1.6 mm, and is applied with a lubricant. The sleeve is for the locking pin to be inserted therein, and internally includes an inner thread corresponding to the self-releasing thread and a lower surface for the locking pin to abut against. A through opening for the string to pass through is provided at the sleeve near the lower surface. In implementation, one end of the string is passed through the through opening and the sleeve is allowed to rotate into the rotating shaft until the locking pin closely abuts against the string. The other end of the string is preserved with certain tension and secured on the stringed instrument, hence completing the installation of the string. Accordingly, because the self-releasing thread has a larger thread pitch size and is applied with the lubricant, a greater part of the tension of the string may be transformed to a linear thrust and friction is also reduced by the lubricant, thereby increasing the minimum secure fastening torque of the self-releasing thread. In other words, in the string tuning device of the present invention, during a tension changing period of the string, given that the tension of the string is maintained under a predetermined value (lower than the minimum secure fastening torque), the sleeve does not become dead locked. When the string is loosened, the string self releases and may be conveniently removed from the sleeve, such that the string may be removed without involving any tools to satisfy application requirements.

DETAILED DESCRIPTION OF THE PREFERRED EMBODIMENTS

Details and technical contents of the present invention are given with the accompanying drawings below.

Figure 1:
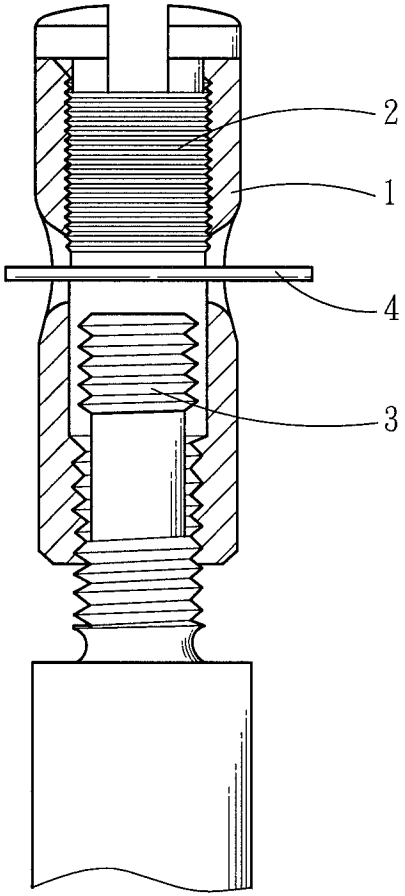
Fig. 1 PRIOR ART
FIG. 1 is a section view of a conventional structure.
Figure 2:
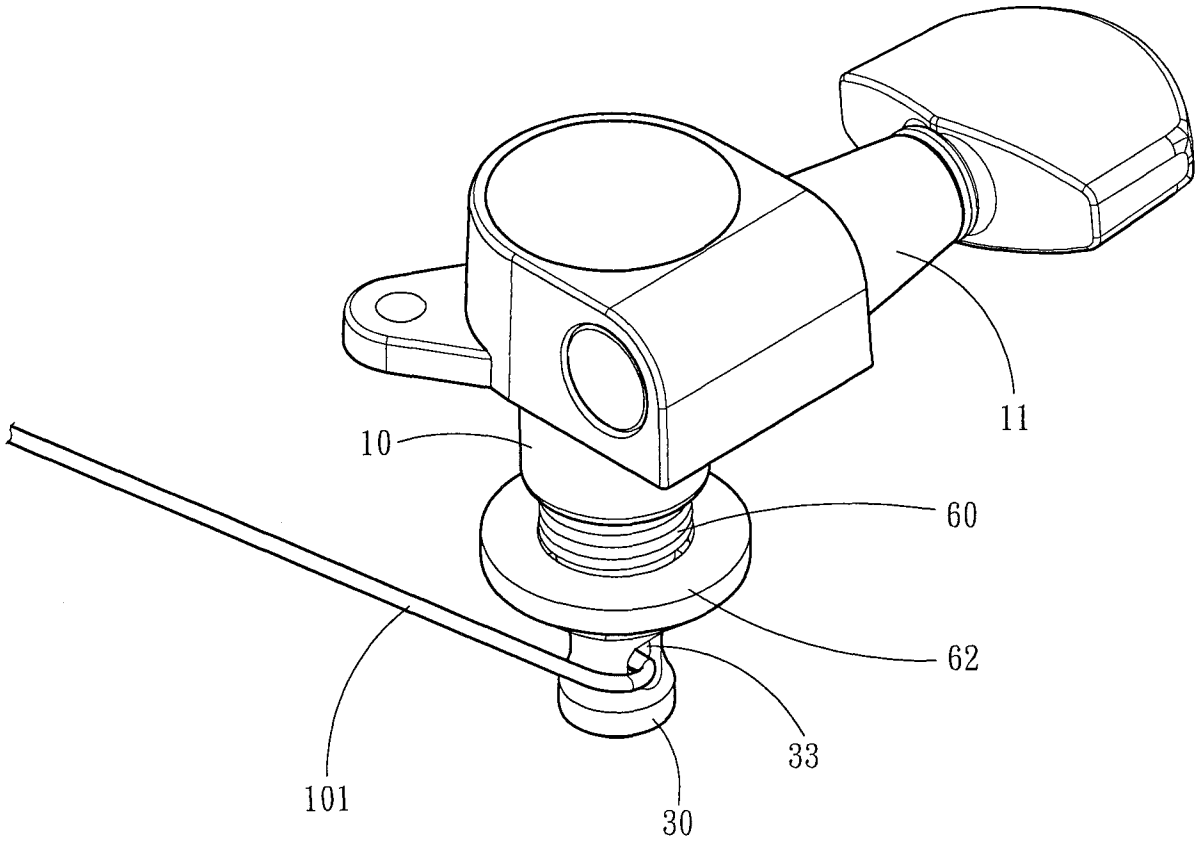
FIG. 2 is a perspective view of a structure according to a preferred embodiment of the present invention.
Figure 3A:
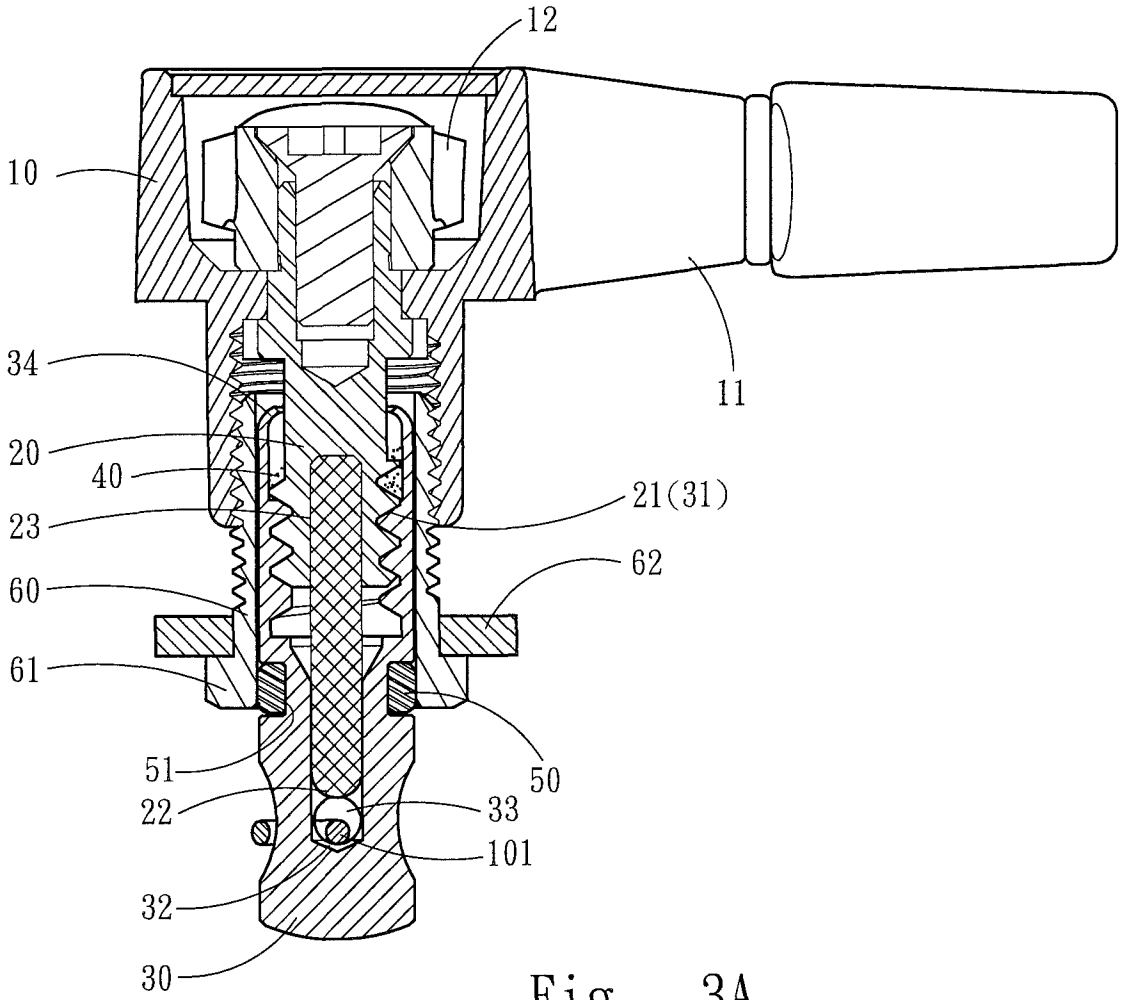
FIG. 3A is a section view of a structure according to a preferred embodiment of the present invention.
Figure 3B:
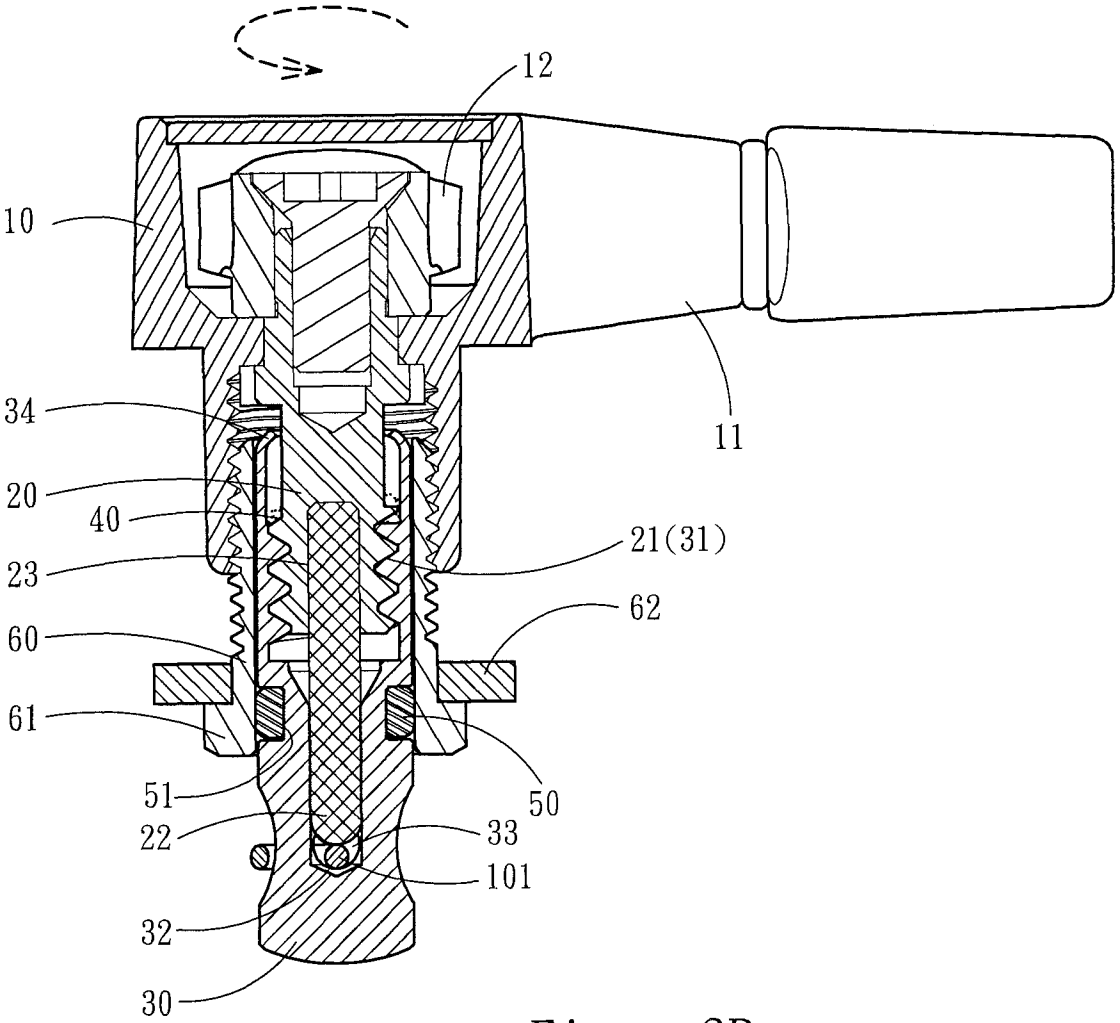
FIG. 3B is section view of an operation of a structure according to a preferred embodiment of the present invention.

FIG. 2, FIG. 3A and FIG. 3B show a perspective view, a section view and a section view of an operation of a structure according to a preferred embodiment of the present invention, respectively. As shown, the present invention provides a self-releasing and self-locking string locking mechanism, which is installed on a stringed instrument (not shown) to adjust a string 101. The self-releasing and self-locking string locking mechanism includes a fixed seat 10 mounted on the stringed instrument, a worm shaft 11, a worm gear 12 driven and rotated by the worm shaft 11, a rotating shaft 20 and a sleeve 30. The worm shaft 11 and the worm gear 12 are installed on the fixed seat 10. The rotating shaft 20 is pivotally connected on the fixed seat 10, and is secured on the worm gear 12.

The rotating shaft 20 includes a self-releasing thread 21 and a locking pin 22. The self-releasing thread 21 has a thread pitch between 1.25 mm and 1.6 mm, and is applied with a lubricant 40. The rotating shaft 20 includes an accommodating groove 23 for accommodating the locking pin 22, which may be freely inserted into the accommodating groove 23.

The sleeve 30 is for the locking pin 22 to be inserted, and internally includes an inner thread 31 corresponding the self-releasing thread 21 and a lower surface 32 for the locking pin 22 to abut against. Further, a through opening 33 for the string 101 to pass through is provided at the sleeve 30 near the lower surface 32. One end of the sleeve 30 is provided with an inward edge 34 that bends inwards and is in contact with the rotating shaft 20. The inward edge 34 blocks the lubricant 40 from leaking, and prevents the sleeve 30 from disengaging and being lost at the same time.

Further, an outer surface of the sleeve 30 may be accommodated by an anti-slip sheath 50, which may be formed by a rubber material. The sleeve 30 may include an outer ring groove 51 for placing the anti-slip sheath 50 to prevent the anti-slip sheath 50 from being excessively protrusive and to simultaneously secure the anti-slip sheath 50. Main purposes of the anti-slip sheath 50 include: 1) stopping the sleeve 30 from rotating to reduce the time that the locking pin 22 needs to tightly abuts against the string 101; 2) preventing the sleeve 30 from rotating and thus from causing the string 101 to slide and become off-pitch during a tension changing period of the string 101, e.g., when a vibrato device is applied on a guitar; 3) providing a necessary reverse torque, such that the string 101 may be easily locked or released when the string 101 is not tensed.

Further, a lining ring 60 may be disposed between the fixed seat 10 and the sleeve 30. The lining ring 60 may coordinate with the fixed seat 10 to abut against a flange 61 of the stringed instrument, and may assist in securing the sleeve 30. The flange 61 and the fixed seat 10 may clamp the stringed instrument to secure the fixed seat 10 on the stringed instrument. In practice, a clamp plate 62 is further applied in conjunction to clamp the stringed instrument.

In conclusion, the present invention provides at least following advantages.

1. The self-releasing thread of the present invention has a larger thread pitch and is applied with the lubricant. Thus, a greater part of the tension of the string is transformed to a linear thrust and friction is reduced, hence increasing the minimum secure fastening torque of the self-releasing thread. In other words, in the string adjusting device of the present invention, during a tension changing period of the string, given that the tension of the string is maintained under a predetermined value, the sleeve does not become dead locked. When the string is loosened, the string self releases and may be conveniently removed from the sleeve, such that the string may be removed without involving any tools to satisfy application requirements.

2. The locking pin is freely inserted into the accommodating groove. Thus, the locking pin does not transmit a lateral torque nor generate any lateral shearing and stretching force, and so the probability of breaking the string may be reduced.

3. With the anti-slip sheath provided, the sleeve may be stopped from rotating to shorten the time that the locking pin needs to tightly abut against the string. During a tension changing period of the string, e.g., when a vibrato device is applied on a guitar, the sleeve is prevented from rotating and thus from causing the string to slide and become off-pitch. Further, through the necessary reverse torque provided by the anti-slip sheath, during a non-tension period of the string, the string may be easily locked or released.

4. The inward edge bending inwards and provided at the end of the sleeve is capable of blocking the lubricant from leaking out and prevents the sleeve from disengaging and being lost at the same time.

What is claimed is:

1. A self-releasing and self-locking string locking mechanism, for adjusting a string, comprising:

a fixed seat;

a worm shaft, installed on the fixed seat;

a worm gear, driven and rotated by the worm shaft, installed on the fixed seat;

a rotating shaft, pivotally connected to the fixed seat, secured on the worm gear, comprising a self-releasing thread and a locking pin, the self-releasing thread having a thread pitch between 1.25 mm and 1.6 mm and applied with a lubricant; and a sleeve, for the locking pin to be inserted therein, internally comprising an inner thread corresponding to the self-releasing thread and a lower surface for the locking pin to abut against, the sleeve further provided with a through opening for the string to pass through near the lower surface.

2. The self-releasing and self-locking string locking mechanism of claim 1, wherein an end of the sleeve is provided with an inward edge, which bends inwards and is in contact with the rotating shaft.

3. The self-releasing and self-locking string locking mechanism of claim 1, wherein the rotating shaft comprises an accommodating groove for accommodating the locking pin, and the locking pin is inserted freely in the accommodating groove.

4. The self-releasing and self-locking string locking mechanism of claim 1, wherein an outer surface of the sleeve is accommodated by an anti-slip sheath.

5. The self-releasing and self-locking string locking mechanism of claim 4, wherein the sleeve comprises an outer ring groove.

6. The self-releasing and self-locking string locking mechanism of claim 1, wherein a lining ring is provided between the fixed seat and the sleeve, and the lining ring comprises a flange.

* * * * *